United States Patent [19]

Zückler

[11] Patent Number: 4,667,070

[45] Date of Patent: May 19, 1987

[54] CONTACT ARRANGEMENT FOR A VACUUM SWITCH

[75] Inventor: Karl Zückler, Berlin, Fed. Rep. of Germany

[73] Assignee: Siemens Aktiengesellschaft, Munich, Fed. Rep. of Germany

[21] Appl. No.: 723,829

[22] Filed: Apr. 16, 1985

[30] Foreign Application Priority Data

Apr. 26, 1984 [DE] Fed. Rep. of Germany ..... 3415743

[51] Int. Cl.[4] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 3,946,179 | 3/1976 | Murano et al. | 200/144 B |
| 4,079,219 | 3/1978 | Weston | 200/144 B |
| 4,438,307 | 3/1984 | Lippmann et al. | 200/144 B |
| 4,445,015 | 4/1984 | Zueckler | 200/144 B |
| 4,553,002 | 11/1985 | Slade | 200/144 B |

FOREIGN PATENT DOCUMENTS

| | | |
|---|---|---|
| 2638700 | 3/1978 | Fed. Rep. of Germany . |
| 3231593 | 3/1984 | Fed. Rep. of Germany . |

*Primary Examiner*—Robert S. Macon

*Attorney, Agent, or Firm*—Kenyon & Kenyon

[57] ABSTRACT

A contact arrangement for a vacuum switch, which includes a stationary contact member, a movable contact member, and exactly one coil member. The movable contact member has an axis of motion that extends to the stationary contact member. The stationary contact member and the movable contact member are each in the form of a cup with a cylindrical side wall having a multiplicity of slots inclined at an angle with respect to a circular bottom wall, the orientation of the slots of the stationary and movable contact members being substantially the same. Each of the contact members also has a circular contact disk that engages the side wall opposite the bottom wall. Circumferentially-directed components of electrical current flowing in the side walls of the stationary and movable contact members generate an axial magnetic field that is substantially parallel to the axis of motion of the movable contact member. The coil member has a path for electrical current to flow in approximately the same direction as the circumferential direction of the circumferentially-directed components of electrical current flowing in the side walls of the stationary and movable contact members. An electrical current that passes through the coil member generates a magnetic field that has an axial component that is substantially parallel to the axis of motion of the movable contact member, the coil member magnetic field amplifying the axial magnetic field generated by the contact members.

5 Claims, 4 Drawing Figures

CONTACT ARRANGEMENT FOR A VACUUM SWITCH

BACKGROUND OF THE INVENTION

The invention relates to a contact arrangement for a vacuum switch, which includes a stationary contact member and a movable contact member that is arranged opposite the stationary contact member in an axial direction. A coil member is connected to the stationary contact member, and an electrical current that passes through the coil member generates an axially-aligned magnetic field.

With respect to known contact arrangements, German Offenlegungsschrift No. 32 27 482 describes a contact arrangement in a vacuum switch wherein each contact member takes the form of a cup. Slots with equal inclination are milled into the walls of the cup. Each of the contact members have a nonadjacent bottom that is connected to a support element that is a support pin. Opposite the bottom of the contact member, each contact member has contact disk that is slotted substantially in a radial direction, the slots functioning to suppress eddy currents.

Further in accordance with the teachings of Offenlegungsschrift No. 32 27 482, the current flowing through the contact members is deflected by the inclined slots in the walls in such a manner that the current is given a current component flowing in the circumferential direction of the contact members. This current component generates a magnetic field that is in phase with the current and permeates the contact members in the axial direction. When the contacts separate, the axial magnetic field acts to diffuse the arc developing between the contact members. Diffusion of the arc results in reduced burn-off of the contact disks. In addition, the axial magnetic field causes a reduction of arc operating voltage, thereby reducing the power reacted in the arc.

Nevertheless, because the angle of inclination of each of the slots in the walls of the contact members is limited by the external dimensions of the contact members, the axial magnetic field produced by the known contact arrangement is relatively weak.

SUMMARY OF THE INVENTION

It is an object of the present invention to describe a contact arrangement for a vacuum switch that results in (1) little stress of the contact members, even if large currents are interrupted; (2) a reduction of operating voltage; and (3) a particularly simple design.

In an embodiment of the present invention, a movable contact member has an axis of motion that extends to a stationary contact member. The side of the stationary contact that faces away from the movable contact member is connected to or associated with a coaxial winding body or coil member. The coaxial winding body or coil member has one end connected to a stationary support element and another end connected to the stationary contact member in such a manner as to allow current flow that aids an axially-oriented magnetic field.

An advantage of the present invention is that the winding body associated with the stationary contact conducts current in a circular track coaxial to the contacts. Therefore, in addition to the axial magnetic field generated by the current flow in the contact members, there is generated by the current in the winding body or coil member a further magnetic field that amplifies or increases the contact-generated magnetic field.

The increase in or amplification of the axial magnetic field improves the quenching of the arc drawn between the contacts when the contacts are separated. Furthermore, the additional magnetic field reduces the operating voltage of the arc and thus, in turn, reduces the power reacted in the arc. Moreover, the transition from a diffused arc to a ontracting arc is shifted toward larger currents. Therefore, the arc is diffused even in the case of relatively large currents, resulting in little burn-off of the contact disks.

A further advantage of the magnetic field additionally generated by the current in the winding body or coil member is that the combination of the winding-generated magnetic field and the contact-generated magnetic field results in particularly strong attracting forces between the contacts. Therefore, large current pulses can be controlled when the contacts lie on top of each other because said attracting forces generate the necessary contact pressure without the need for a particularly strong compression spring (in conjunction with the movable contact member) to generate the necessary contact pressure.

In an embodiment of the present invention, the winding body or coil member is arranged axially shifted on the stationary contact member's side that faces away from the movable contact. The magnetic field generated by the electrical current in the coil member has, in the area between the stationary contact member and the movable contact member, not only a strong axial magnetic field component, but also a radial magnetic field component. When the contact members are separating, this radial magnetic field component generates a force acting on the arc between the contacts, which moves the arc on a circular track along the surfaces of the contact disks. The burn-off on the contact disks is further reduced by this revolving arc.

It is known from, inter alia, German Offenlegungsschrift No. 31 51 907, that the arc generated during the separation of contact members can be influenced by magnetic fields. A radial magnetic field moves the arc around a circular track, and an axial magnetic field counteracts the contraction of the arc.

In the contact arrangement described in German Offenlegungsschrift No. 31 51 907, the walls of two oppositely arranged contacts are provided with respectively oppositely inclined slots for generating an exclusively radial magnetic field between the contacts. Further in accordance with the teachings of German Offenlegungsschrift No. 31 51 907, an axial magnetic field is generated by a coil member at the stationary contact member and a coil member at the movable contact, wherein the magnetic fields of the contact members and the two coil members are superimposed and partially attenuated.

The present invention requires substantially less technical means than that required by German Offenlegungsschrift No. 31 51 907 to generate an axial magnetic field. The reason is that, in the present invention, a single coil member associated with or connected to the stationary contact member is sufficient to generate an axial magnetic field because the inclined slots in the walls of the contact members have the same inclination. Therefore, the present invention yields a reduction in weight of a vacuum switch containing a contact arrangement. In addition, the drive for the movable contact member can be laid out substantially more simply because, during separation of the contacts, the mass to be accelerated by the drive is considerably smaller.

In one embodiment of the present invention, the contact arrangement is provided, in a manner known per se (see German Offenlegungsschrift No. 32 27 482), with contact members in the form of cup contacts. The walls of the cup contacts are provided with equally inclined slots for generating an axially aligned magnetic field. The coil member of the contact arrangement has a direction of winding, from one end of the coil member to the other end, that points approximately in the direction in which the slots in the side wall of the stationary contact member run toward the movable contact. In this embodiment, the direction of winding of the coil member corresponds to the direction of winding of the line sections formed, in the two contact members, by the inclined slots. Therefore, the current flowing through the coil member generates a magnetic field that amplifies the axial magnetic field starting from the contact members.

In another embodiment of the present invention, the coil member consists of an open ring that is connected at one end to the stationary support element by means of a radial line section. The other end of the open ring is connected to the stationary contact member by means of a further radial line section. The open ring and the radial line sections have large cross-section areas in order to keep the heat losses in the vacuum switch small. The weight increase resulting from the large cross-section areas is only of secondary importance because the coil member is connected to or associated only with the stationary contact member (and not with the movable contact member), and, therefore, does not need to be accelerated when the contact members are separated.

In another embodiment of the present invention, the inside diameter of the open ring of the coil member corresponds to approximately the outside diameter of the contact members. Therefore, advantageously, the magnetic field generated by the current in the open ring also permeates the outer regions of the contact members.

In another embodiment of the present invention, the oontact arrangement contains contact members that are formed as cup contacts, each with a respectively slotted bottom plate and a contact disk that rests on a wall like a lid. The contact disk is likewise slotted. Each inclined slot in the wall is in communication with a further slot in the bottom plate and, additionally, with a respective slot in the contact disk. It is advantageous to form the further slots in the bottom plate and the respective slots in the contact disk such that the slots deviate from the radial direction. The result is that, in the bottom wall or plate and the contact disk, the current flow in the region between two adjacent further or additional slots has a current component in the circumferential direction that yields a magnetic field that amplifies or increases the axial magnetic field of the respective contact member.

In another embodiment of the present invention, the bottom plate or wall and the contact disk are subdivided by further and additional slots, located in the bottom plate or wall and the contact disk, into line sections. The respective center of their cross-sectional area in the central region of the bottom plate (or wall) or the contact disk is offset from the center of the cross-sectional area of the respective line section in the region of the outer rim of the bottom plate or contact disk, deviating from the radial direction in the circumferential direction of the contact member in such a manner that the current flowing through the bottom plate (or wall) and the contact disk, as well as through the inclined slotting of the wall, is given a current component in the circumferential direction. The circumferential current component causes a further increase of the axial magnetic field between the contacts.

In another embodiment of the present invention, the further and additional slots in the bottom plates (or walls) and the contact disks of the contact members are formed so that they are spiral-shaped in the bottom plate and likewise in spiral form of the opposite curvature in the contact disk.

In another embodiment of the present invention, every inclined slot in the side wall of each contact member, together with the associated further slot in the bottom plate, extends in one plane. The additional slots in the contact disk are arranged so that every additional slot extends in a straight line in the plane of the inclined slot (in the side wall) associated therewith and with further slots in the bottom plate. As a result, the slots can advantageously be worked or cut into a respective contact member in a simple manner by straight saw cuts.

The above and other objects, aspects, features, and advantages of the invention will be more readily perceived from the following description of the preferred embodiments thereof when considered with the accompanying drawings and appended claims.

BRIEF DESCRIPTION OF THE DRAWINGS

The present invention is illustrated by way of example and not limitation in the figures of the accompanying drawings in which like references indicate similar parts, and in which.

DESCRIPTION OF THE INVENTION

Figure 1:
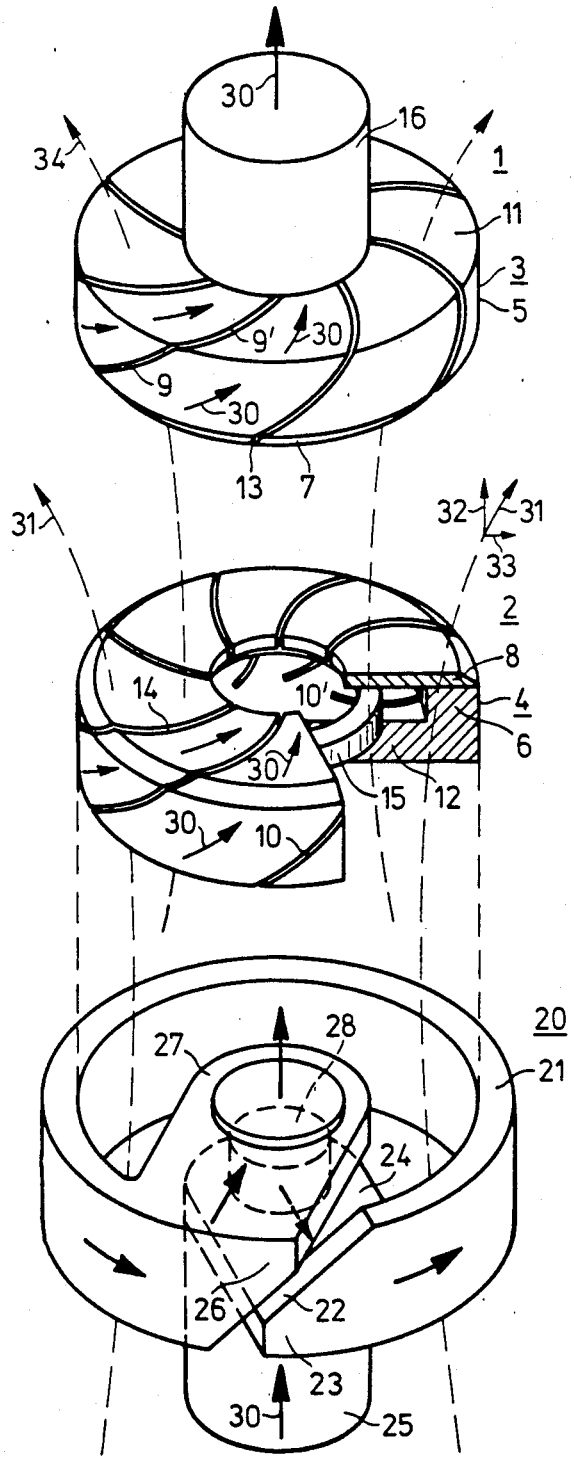
FIG. 1 is an exploded-perspective view of an embodiment of the present invention with spiral-shaped slots.

Referring now to the drawings, embodiments of a contact arrangement for a vacuum switch according to the invention are illustrated.

The contact arrangement shown in FIG. 1 comprises a movable contact member 1 and a stationary contact member 2, which are arranged opposite each other in the axial direction. Both contact members 1 and 2 are designed as so-called cup contacts, and each consists of a cup-shaped contact support 3 and 4 and one of the contact disks 7 and 8 resting on the circular rim surfaces of the walls 5 and 6 of the two contact supports 3 and 4. In order to show this more distinctly, a sector-shaped part is cut out in FIG. 1 from the stationary contact 2.

The walls 5 and 6 of the two contact supports 3 and 4 are provided in the circumferential direction with inclined slots 9 and 10 which are inclined in the same manner relative to the contact disks 7 and 8 of the contact members 1 and 2. The inclined slots 9 and 10 continue in spiral shape in the form of further slots 9' and 10' in the bottom plates 11 and 12 of the contact supports 3 and 4 from their outer rim to a circular disk-shaped region in the center of the respective bottom plate or wall 11 or 12. The spiral-shaped slots 9' and 10' in the bottom plates 11 and 12 are curved there in a circumferential direction of the respective contact members 1 or 2 which correspond to the circumferential direction in which the slots 9 and 10 in the walls 5 and 6 of the contact members 1 and 2 are inclined in the direction toward the respective contact disk 7 or 8.

The contact disks 7 and 8 resting on the rim surfaces of the walls 5 and 6 consist of a composite chromium-copper material and exhibit additional slots 13 and 14 which are likewise of spiral form but with a curvature opposed to that of the slots 9' and 10' in the respective bottom plates or walls 11 and 12. Each contact member 1 and 2 contains one annular support body 15 which is not visible in the movable contact member 2 and is arranged in the interior of the respective contact member 1 or 2 between its bottom plate or wall 11 or 12 and the contact disk 7 or 8. The support body 15 consists preferably of a poorly conducting magnetic material with very small remanence, such as ferrite.

The movable contact member 1 is connected in the circular region in the center of its bottom 11 to a cylindrical support element 16 which has the form of a support pin and is shown only sectionwise.

With the stationary contact 2 is associated on its side facing away from the movable contact a coil form or member 20 which consists substantially of an open ring 21, the inside diameter of which corresponds approximately to the outside diameter of a stationary and the movable contact member 2 and 1. The ring 21 has a separating gap 22 extending at an angle to the ring plane, in the vicinity of which the open ring 21 is provided at its one end 23 with a radial line section 24 that extends to the center of the ring 21. There, the open ring 21 is placed with its line section 24 on a stationary support element or member 25 designed as a support pin. At its other end 26, the open ring 21 is provided with a further radial line section 27 which extends at a parallel distance from the line section 24 likewise to the center of the ring 21. There, the stationary contact member 2 is placed on the line section 27 with the center region of the bottom plate or wall 12 of its contact support 4. Between the two radial line sections 24 and 27, an insulating spacer 28 is arranged which prevents mutual contact between the line sections 24 and 27.

The current flow through the entire contact arrangement is indicated by the arrows 30. The current through the coil form member 20 generates a magnetic field, the direction of which is indicated by the dashed arrows 31. In the region between the contact members 1 and 2, the magnetic field 31 generated in the coil form or member 20 has an axial magnetic field component 32 and a radial magnetic field component 33. On the axial magnetic field component 32 is superimposed the axial magnetic field 34 generated by the current component flowing in the contact members 1 and 2 in the circumferential direction.

Figure 2:
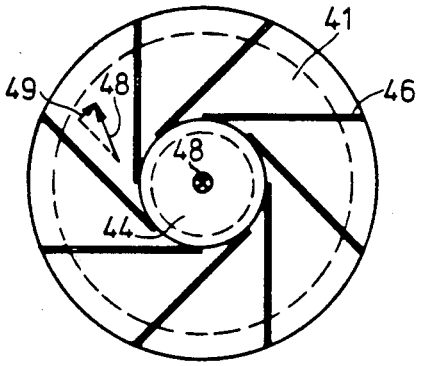
FIG. 2 is a bottom view of an embodiment of the invention having planar slots.
Figure 3:
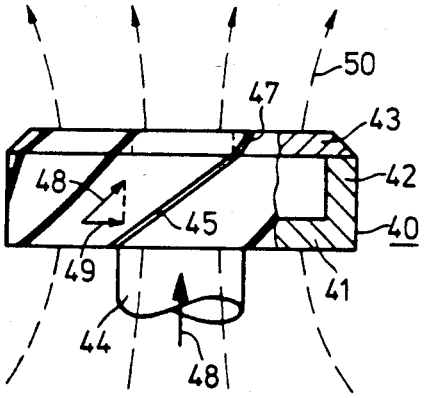
FIG. 3 is a side view of said embodiment.
Figure 4:
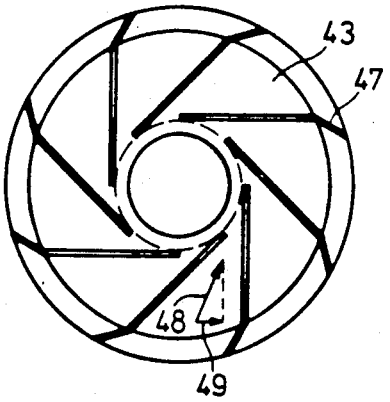
FIG. 4 is a top view of said embodiment.

An embodiment example of a contact member of the contact arrangement according to the invention shown in FIGS. 2, 3 and 4 is designed, like the contacts shown in FIG. 1, as a cup contact which comprises a cup-shaped contact support 40 with a bottom plate or wall 41 and a hollow-cylindrical wall 42; on the wall 42 rests, in lid-fashion, a contact disk 43 fastened thereto. The contact is connected in the vicinity of center of its bottom plate 41 to a support element or member 44 which with the stationary contact member, is part of a coil form, not shown, according to FIG. 1 and, in the case of a movable contact member, in the form of a movable support pin. The wall 42 of the contact is provided in the circumferential direction at regular spacing with oblique slots 45 which are inclined in agreement with the contact disk 43. The bottom place 41 and the contact disk 43 each have the same number of further slots 46 and additional slots 47 which extend in a straight line from the outer rim to a circular region in the center of the bottom plate 41 or the contact disk 43. Each inclined slot 45 in the wall 42 runs, together with the respective further slot 46, in the bottom plate 41 and the additional slot 47 in the contact disk 43 in one plane.

Due to the inclined slots 45 in the wall 42 and the further and additional slots 46 and 47 in the bottom plate 42 and in the contact disk 43 extending in deviation from the radial direction, a current 48 flowing through the contact is given, in the wall 42 as well as in the bottom plate or wall 41 and in the contact disk 43, a current component 49 in the circumferential direction of the contact. These current components 49 generate a magnetic field 50 permeating the contact axially.

Certain changes and modifications of embodiments of the invention disclosed herein will be apparent to those skilled in the art. Applicant intends to cover by his claims all those changes and modifications that could be made to the embodiments herein, chosen for the purposes of disclosure, without departing from the spirit and scope of the invention.

What is claimed is:

1. A contact arrangement for a vacuum switch, which comprises:

a stationary contact member;

a movable contact member having an axis of motion that extends to the stationary contact member, the stationary contact member and the movable contact member each in the form of a cup symmetrical about an axis of symmetry and having a circular bottom wall and a cylindrical side wall perimetrically attached thereto, the side wall being provided with a multiplicity of first slots inclined at an angle with respect to the bottom wall, each of the contact members having a respective circular contact disk engaging an end of the side wall opposite the bottom wall, the orientation of the first slots of the stationary contact member relative to the contact disk of the stationary contact member being substantially the same as the orientation of the first slots of the movable contact member relative to the contact disk of the movable contact member such that a circumferentially-directed component of an electrical current flowing in the side wall of the stationary contact member in conjunction with a circumferentially-directed component of an electrical current flowing in the side wall of the movable contact member generate an axis magnetic field that is substantially parallel to the axis of motion of the movable contact member, the circumferential direction of the circumferentially-directed component of the electrical current flowing in the side wall of the stationary contact member being substantially the same as the circumferential direction of the circumferentially-directed component of the electrical current flowing in the side wall of the movable contact member;

exactly one coil member with a first end and a second end, the first end engaging a stationary support member and the second end engaging the stationary contact member, the coil member having a path from the first end to the second end for an electrical current to flow in approximately the same direction as the circumferential direction of the circumferentially-directed component of the electrical current flowing in the side wall of the stationary contact member and the circumferentially-directed component of the electrical current flowing in the side wall of the movable contact member, wherein the electrical current that passes through the coil member generates a magnetic field that has an axial component that is substantially parallel to the axis of motion of the movable contact member, the coil member magnetic field amplifying the axial magnetic field generated by the contact members.

2. The contact arrangement for a vacuum switch as recited in claim 1, wherein the path from the first end of the coil member to the second end of the coil member is in the form of an open ring, with a first radial member that connects the open ring with the stationary support member and a second radial member that connects the open ring with the stationary contact member.

3. A contact arrangement for a vacuum switch, which comprises:

a stationary contact member;

a movable contact member having an axis of motion that extends to the stationary contact member; the stationary contact member and the movable contact member each in the form of a cup symmetrical about an axis of symmetry and having a circular bottom wall and a cylindrical side wall perimetrically attached thereto, the side wall being provided with a multiplicity of first slots inclined at an angle with respect to the bottom wall, each of the contact members having a respective circular contact disk engaging an end of the side wall opposite the bottom wall, the orientation of the first slots of the stationary contact member relative to the contact disk of the stationary contact member being substantially the same as the orientation of the first slots of the movable contact member relative to the contact disk of the movable contact member, each bottom wall being provided with a multiplicity of second slots communicating with respective ones of the first slots, each circular contact disk having a multiplicity of third slots communicating with respective ones of the first slots, wherein each of the second and third slots extend from the side wall to an interior of the circular contact disk, each of the second slots and third slots deviating from a radially-oriented plane containing the axis of symmetry of the cup, wherein a circumferentially-directed component of an electrical current flowing in the bottom wall, the side wall, and the circular contact disk of the stationary contact member in conjunction with a circumferentially-directed component of an electrical current flowing in the bottom wall, the side wall, and the circular contact disk of the movable contact member generate an axial magnetic field that is substantially parallel to the axis of motion of the movable contact member, the circumferential direction of the circumferentially-directed component of the electrical current flowing in the bottom wall, the side wall, and the circular contact disk of the stationary contact member being substantially the same as the circumferential direction of the circumferentially-directed component of the electrical current flowing in the bottom wall, the side wall, and the circular contact disk of the movable contact member;

exactly one coil member with a first end and a second end, the first end engaging a stationary contact member, the coil member having a path from the first end to the second end for an electrical current to flow in approximately the same direction as the circumferential direction of the circumferentially-directed component of the electrical current flowing in the bottom wall, the side wall, and the circular contact disk of the stationary contact member and the circumferentially-directed component of the electrical current flowing in the bottom wall, the side wall, and the circular contact disk of the movable contact member, wherein the electrical current that passes through the coil member generates a magnetic field that has an axial component that is substantially parallel to the axis of motion of the movable contact member, the coil member magnetic field amplifying the axial magnetic field generated by the contact members.

4. The contact arrangement for a vacuum switch as recited in claim 3, wherein the second slots are spiral-shaped and the third slots are spiral-shaped, the third slots having a curvature that is opposed to a curvature of the second slots.

5. The contact arrangement for a vacuum switch as recited in claim 3, wherein each of the third slots extends along a straight line in a plane defined by the respective first slot and the respective second slot communicating therewith.

* * * * *